US012693080B2

(12) United States Patent
Conway et al.

(10) Patent No.: US 12,693,080 B2
(45) Date of Patent: Jul. 28, 2026

(54) WASTEWATER HEAT RECOVERY SYSTEMS

(71) Applicant: KOHLER MIRA LIMITED, Cheltenham (GB)

(72) Inventors: Sean Conway, Cheltenham (GB); Oliver Jones, Cheltenham (GB); Steven Richard Sandell, Cheltenham (GB); James Cranwell, Cheltenham (GB); Bradley Edwards, Cheltenham (GB)

(73) Assignee: Kohler Mira Limited, Cheltenham (GB)

( * ) Notice: Subject to any disclaimer, the term of this patent is extended or adjusted under 35 U.S.C. 154(b) by 127 days.

(21) Appl. No.: 18/408,097

(22) Filed: Jan. 9, 2024

(65) Prior Publication Data

US 2024/0230243 A1 Jul. 11, 2024

Related U.S. Application Data

(60) Provisional application No. 63/479,210, filed on Jan. 10, 2023.

(51) Int. Cl.
*F28F 1/04* (2006.01)

(52) U.S. Cl.
CPC ..... *F28F 1/04* (2013.01)

(58) Field of Classification Search
CPC ..... F28F 1/04
USPC ..... 165/168
See application file for complete search history.

(56) References Cited

U.S. PATENT DOCUMENTS

| | | | | |
|---|---|---|---|---|
| 4,304,292 | A * | 12/1981 | Cardone | F24D 17/001 165/47 |
| 9,651,316 | B2 * | 5/2017 | Cai | F28D 21/0012 |
| 9,970,183 | B2 * | 5/2018 | Holm | F28D 21/0012 |
| 2012/0125587 | A1 * | 5/2012 | Cai | F28D 21/0012 165/177 |

(Continued)

FOREIGN PATENT DOCUMENTS

| | | | | |
|---|---|---|---|---|
| DE | 3919543 | A1 | 12/1990 | |
| DE | 19608404 | A1 * | 5/1997 | F28D 21/0012 |
| GB | 2456570 | A | 7/2009 | |

OTHER PUBLICATIONS

European Official Action dated May 16, 2024 issued in corresponding European application.

*Primary Examiner* — Devon Lane
(74) *Attorney, Agent, or Firm* — Husch Blackwell LLP

(57) ABSTRACT

The heat exchanger tray provided herein may include a base, a cover, and a heat exchange coil. The base may include a cutout and a bottom portion with one or more sidewalls forming a serpentine path for wastewater. The cover may be positioned within the cutout of the base to create a space between the base and the cover. The cover may include one or more protruding portions that engage with the one or more sidewalls of the bottom portion of the base to enclose the serpentine path. The heat exchange coil may be positioned in and along at least a portion of the serpentine path between the base and the cover. Fresh water may flow through the heat exchange coil. Wastewater may flow through the serpentine path between the base and the cover, such that the wastewater may heat the fresh water flowing through the heat exchange coil.

10 Claims, 4 Drawing Sheets

(56) References Cited

U.S. PATENT DOCUMENTS

| | | | | |
|---|---|---|---|---|
| 2014/0237714 | A1* | 8/2014 | Rusch | F28F 1/00<br>156/278 |
| 2014/0311709 | A1* | 10/2014 | Chan | F28D 7/12<br>165/104.11 |

* cited by examiner

WASTEWATER HEAT RECOVERY SYSTEMS

CROSS-REFERENCE TO RELATED APPLICATIONS

The present application claims priority to U.S. Provisional Patent Application No. 63/479,210, filed Jan. 10, 2023, entitled, "WASTEWATER HEAT RECOVERY SYSTEMS," the entire contents of which are hereby incorporated by reference.

BACKGROUND

This application relates generally to a heat exchange tray. More specifically, this application relates to a heat exchange tray configured to recover heat from shower wastewater to increase the temperature of water traveling to the shower.

Figure 1:
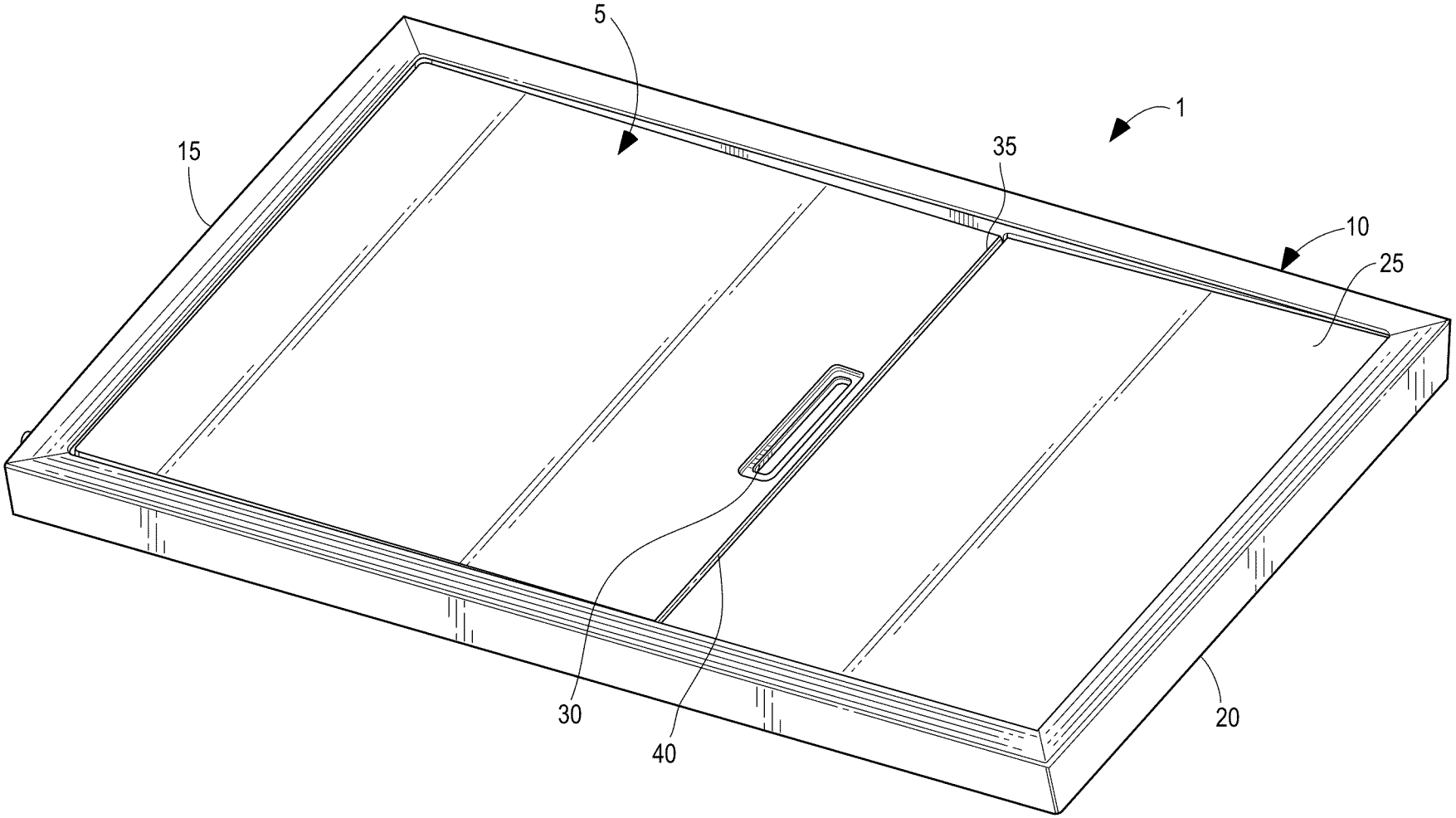
FIG. 1 is a perspective view of an example heat exchange tray.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Turning first to FIG. 1, a heat exchange tray 1 may be provided for a user to stand on when showering. The heat exchange tray 1 may include a cover 5 which may sit atop or be inset within a base 10 of the heat exchange tray 1. The base 10 may include a cutout configured to receive the cover 5. The cover 5 may attach to or be integrally formed with the base 10. When water flows on the heat exchange tray 1 during a shower, water may flow via gravity from each of a first end 15 and a second end 20 of the heat exchange tray 1. Water may flow via gravity down the cover 5 and a sloped portion 25 of the base 10. Water may flow toward a heat chamber inlet 30 to enter a heat exchange chamber (not illustrated, as the heat exchange chamber is covered by the cover 5). In alternative embodiments, heat chamber inlet 30 may be positioned near or at the first end 15 or second end 20. In such an embodiment, the cover 5 may extend most or all of the length of the base 5 such that sloped portion 25 is smaller or not present.

The heat chamber inlet 30 may be placed near an end 35 of the cover 5. The end 35 of the cover 5 may be on an opposite side of the cover 5 relative to the first end 15 of the heat exchange tray 1. The heat chamber inlet 30 may be positioned near a connection point 40 of the cover 5 and the sloped portion 25 of the base 10. The heat chamber inlet 30 may be positioned in any suitable manner, such that gravity causes water to flow toward and into the heat chamber inlet 30.

Figure 2:
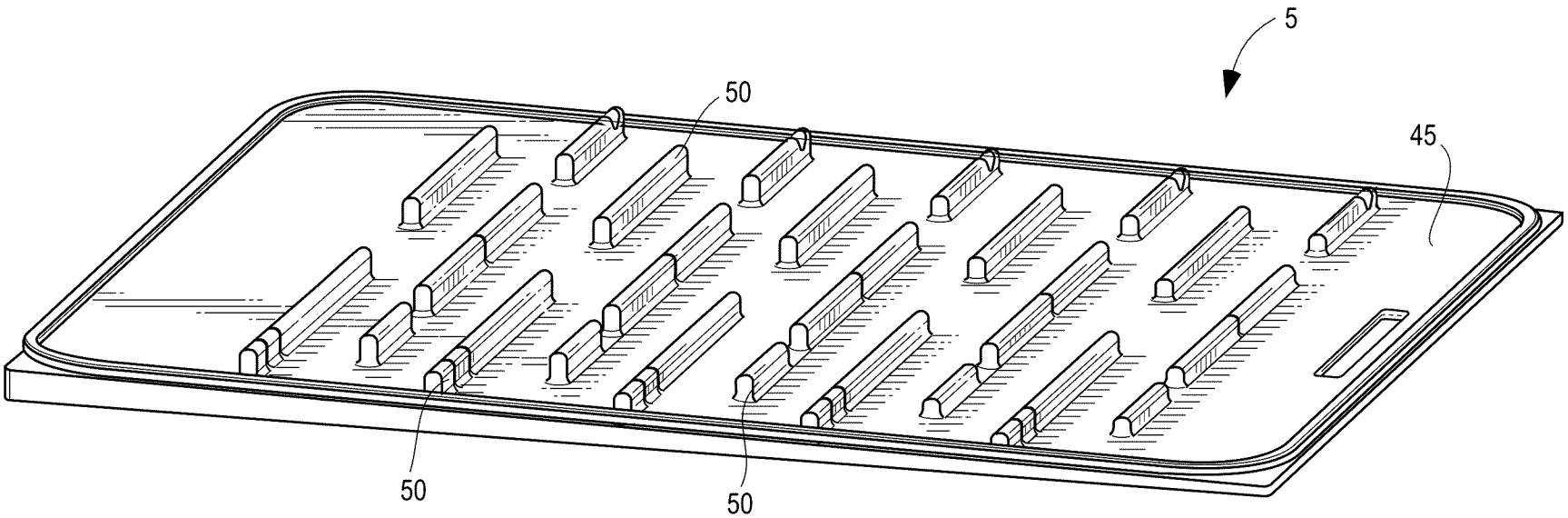
FIG. 2 is a perspective view of an example cover.
Figure 3:
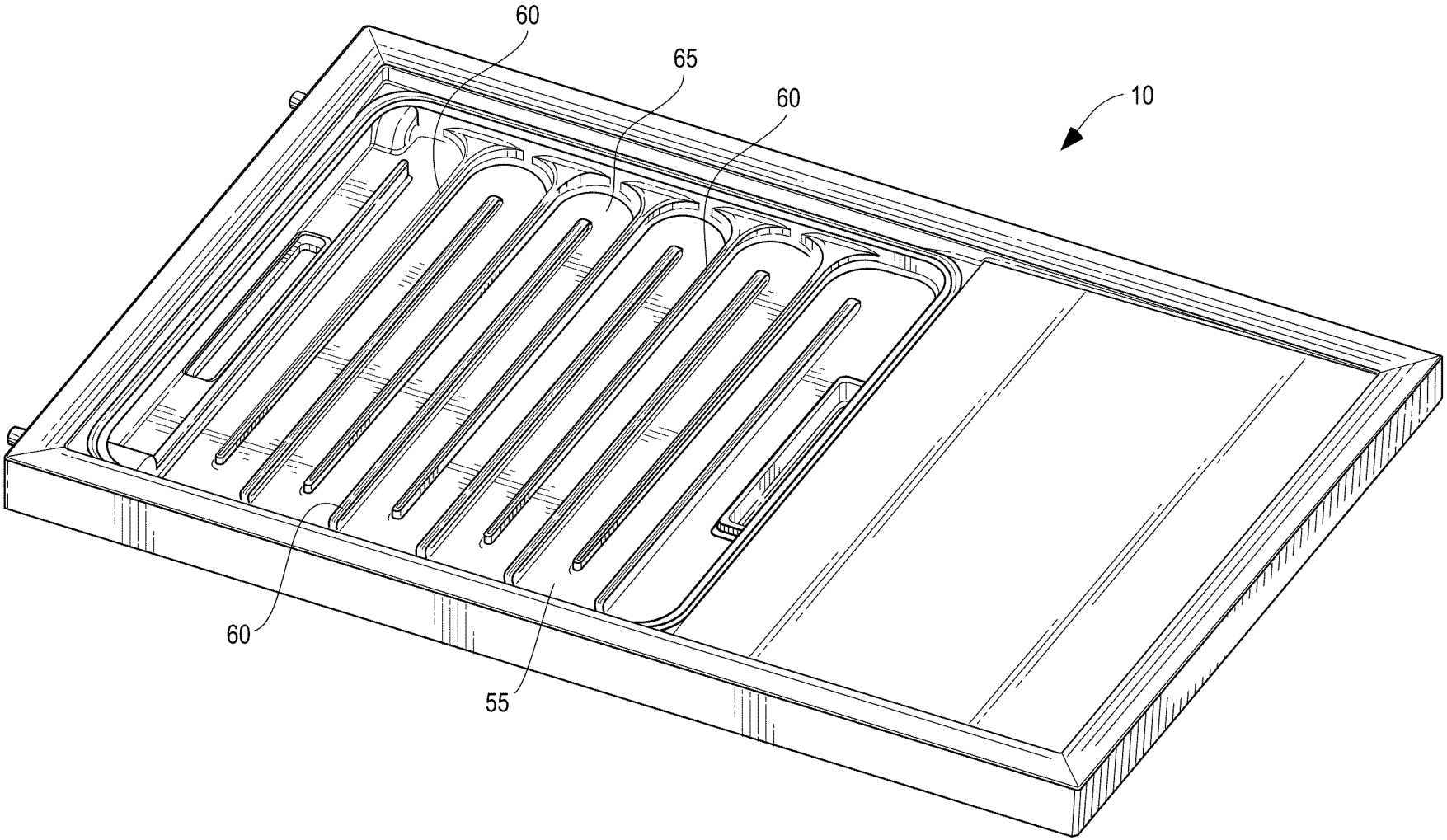
FIG. 3 is a cross-sectional view of an example heat exchange tray.
Figure 4:
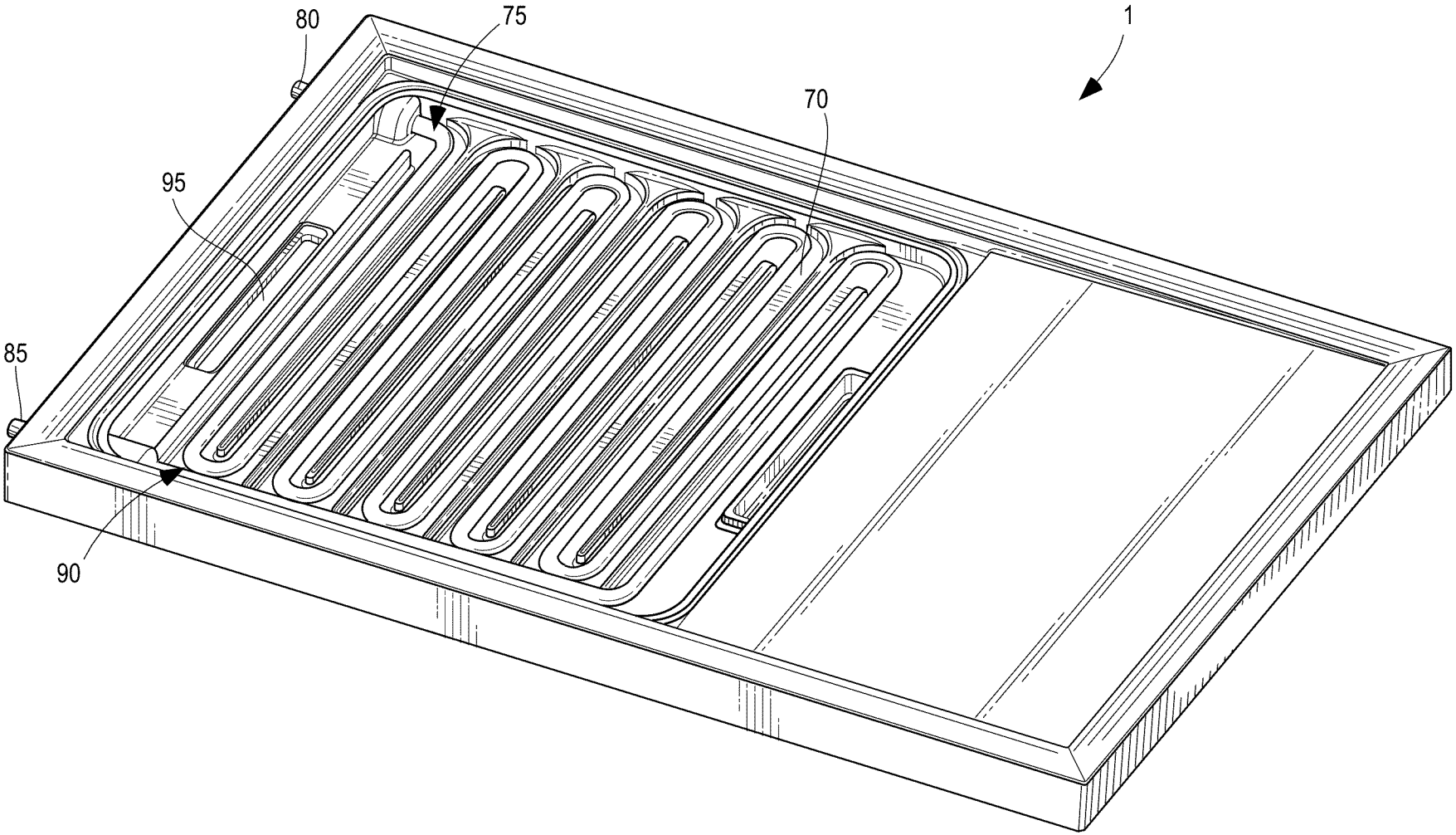
FIG. 4 is a cross-sectional view of an example heat exchange coil placed within an example heat exchange tray.

As illustrated in FIG. 2, an underside 45 of the cover 5 may include a plurality of protruding portions 50, which may be flow-directing features. The protruding portions 50 may be positioned in such a way that the base 10 may be integrated with the cover 5. As illustrated in FIG. 3, a bottom portion 55 of the base 10 may include one or more sidewalls 60 which may form a path 65. The protruding portions 50 of FIG. 2 may engage with the sidewalls 60 of the path 65 of FIG. 3 in order to form a wastewater flow path 70, as illustrated in FIG. 4. Such engagement may take the form of an abutting relationship, or the protruding portions 50 may fit with or around the sidewalls 60 to form such engagement.

Turning now to FIG. 4, a heat exchange coil 75 may carry water to be heated. Water may enter the heat exchange coil 75 via an inlet 80 and may flow out of the heat exchange coil 75 via an outlet 85. The inlet 80 and outlet 85 may be switched such that the water enters and exits the tray 1 from opposite sides of the tray 1.

The heat exchange coil 75 may be positioned along the wastewater flow path 70. The heat exchange coil 75 may "snake" along the wastewater flow path 70 and may be fitted along the wastewater flow path 70. The heat exchange coil 75 may be any suitable length to fit the wastewater flow path 70. The heat exchange coil 75 may connect to, be attached to, or be integrally formed with the wastewater flow path 70 in any suitable manner. The heat exchange coil 75 may be made of copper or any other suitable material with beneficial heat transfer qualities. Using copper or another material with desirable heat transfer properties for the heat exchange coil 75 may improve the effectiveness of heat transfer.

When the cover 5 is attached to or placed within the base 10, water may enter a heat exchange chamber 90 via the heat chamber inlet 30. The heat exchange chamber 90 may be formed by the heat exchange coil 75 fitted along the wastewater flow path 70. Fresh water may flow into and through the heat exchange coil 75. When flowing through the heat exchange coil 75 in the heat exchange chamber 90, fresh water in the heat exchange coil 75 may be heated by the wastewater flowing along the wastewater flow path 70. The heat exchange coil 75 may therefore be positioned between a freshwater inlet and an ablutionary fitting. After passing through the heat exchange chamber 90, water may exit the heat exchange tray 1 via a wastewater outlet 95. A waste trap fitment or filter may be placed at the wastewater outlet 95 in order to collect or remove waste from the wastewater.

There may be a void beneath the heat exchange chamber 90, which may act as still air gap insulation or may be filled with an insulating material including but not limited to a foamed polymer or other insulation. The insulating material may serve as a mechanism to enhance heat exchange between the wastewater and the water flowing through the heat exchange coil 75. The insulation may assist with heat transfer by reducing losses of heat to the atmosphere or building structure, and/or act as a safety feature to prevent leaks. The insulation may be expansive foam or a molded insert.

As is evident from the foregoing description, certain aspects of the present invention are not limited by the particular details of the examples illustrated herein, and it is therefore contemplated that other modifications, applications, variations, or equivalents thereof, will occur to those skilled in the art. Many such changes, modifications, variations, and other uses and applications of the present constructions will, however, become apparent to those skilled in the art after considering the specification and the accompanying drawings. In addition, unless mention was made above to the contrary, it should be noted that all of the accompanying drawings are not to scale. All such changes, modifications, variations, and other uses and applications which do not depart from the spirit and scope of the present inventions are deemed to be covered by the inventions which are limited only by the claims which follow.

The invention claimed is:

1. A heat exchanger tray comprising:

a base comprising a cutout, the base including a bottom portion with a plurality of sidewalls forming a serpentine path for wastewater;

a cover positioned within the cutout of the base to create a vertical space between the plurality of sidewalls and the cover, the cover including a plurality of flow-directing features positioned above the plurality of sidewalls of the bottom portion of the base, wherein each flow-directing feature engages a respective sidewall to at least partially block the vertical space between the respective sidewall and the cover; and a heat exchange coil positioned in and along at least a portion of the serpentine path between the base and the cover;

wherein fresh water flows through the heat exchange coil; and wherein the plurality of sidewalls and the plurality of flow-directing features cooperate to direct the wastewater to flow through the serpentine path between the base and the cover, such that the wastewater heats the fresh water flowing through the heat exchange coil; and wherein the plurality of sidewalls are spaced apart from one another in a first direction and the plurality of flow-directing features are spaced apart from one another in the first direction and each flow-directing feature extends in a discontinuous manner in a second direction perpendicular to the first direction.

2. The heat exchanger tray of claim 1, wherein the plurality of sidewalls and the plurality of flow-directing features create a wastewater flow path.

3. The heat exchanger tray of claim 1, wherein the heat exchange coil is made of copper.

4. The heat exchanger tray of claim 1, wherein the wastewater enters the heat exchanger tray via a heat chamber inlet.

5. The heat exchanger tray of claim 1, wherein the wastewater exits the heat exchanger tray via a wastewater outlet.

6. The heat exchanger tray of claim 1, wherein the fresh water enters the heat exchange coil via an inlet, and wherein the fresh water heated via the wastewater exits the heat exchange coil via an outlet.

7. The heat exchanger tray of claim 1, wherein each flow-directing feature has one or more interruptions that allow the wastewater to flow through a portion of the vertical space between the respective sidewall and the cover in the first direction.

8. The heat exchanger tray of claim 1, wherein the plurality of flow-directing features are offset in a second direction perpendicular to the first direction.

9. The heat exchanger tray of claim 8, wherein the plurality of sidewalls are offset in the second direction and the offset of the plurality of flow-directing features complements the offset of the plurality of sidewalls.

10. The heat exchanger tray of claim 1, wherein the plurality of flow-directing features engages the plurality of sidewalls via an abutting relationship.

* * * * *